United States Patent [19]

Wössner et al.

[11] 4,322,947

[45] Apr. 6, 1982

[54] CONTROL APPARATUS FOR A FUEL SUPPLY SYSTEM FOR MIXTURE-COMPRESSING, EXTERNALLY IGNITED INTERNAL COMBUSTION ENGINES

[75] Inventors: Günter Wössner, Esslingen; Helmut Maurer, Schwieberdingen, both of Fed. Rep. of Germany

[73] Assignee: Robert Bosch GmbH, Stuttgart, Fed. Rep. of Germany

[21] Appl. No.: 138,392

[22] Filed: Apr. 8, 1980

Related U.S. Application Data

[63] Continuation of Ser. No. 916,416, Jun. 16, 1978, abandoned.

[30] Foreign Application Priority Data

Jun. 23, 1977 [DE] Fed. Rep. of Germany ..... 2728205

[51] Int. Cl.[3] ..... F01N 3/00

[52] U.S. Cl. ..... 60/285; 123/325; 123/327; 123/198 DB

[58] Field of Search ..... 123/325, 327, 198 D, 123/198 DB; 60/285, 277, 276

[56] References Cited

U.S. PATENT DOCUMENTS

| | | | |
|---|---|---|---|
| 3,463,130 | 8/1969 | Reichardt et al. | 123/325 |
| 3,703,162 | 11/1972 | Aono | 123/325 |
| 3,818,701 | 6/1974 | Foster et al. | 60/285 |
| 3,949,551 | 4/1976 | Eichler et al. | 60/285 |
| 4,015,428 | 4/1977 | Kawai | 60/285 |
| 4,073,269 | 2/1978 | Herth et al. | 60/285 |
| 4,075,988 | 2/1978 | Kato | 123/325 |
| 4,123,903 | 11/1978 | Hayashi | 123/327 |
| 4,134,261 | 1/1979 | Iizuka et al. | 60/277 |
| 4,136,651 | 1/1979 | Hattori et al. | 123/589 |
| 4,165,610 | 8/1979 | Iizuka et al. | 60/285 |

FOREIGN PATENT DOCUMENTS

| | | | |
|---|---|---|---|
| 442615 | 4/1975 | U.S.S.R. | 123/325 |

*Primary Examiner*—Charles J. Myhre
*Assistant Examiner*—Magdalen Moy
*Attorney, Agent, or Firm*—Edwin E. Greigg

[57] ABSTRACT

A control apparatus for a fuel supply system for mixture-compressing, externally ignited internal combustion engines is proposed, which serves to interrupt the fuel supply to the engine during overrunning. The control apparatus comprises sensors which furnish signals according to the attitude of the throttle valve, as well as the rpm of the internal combustion engine and the temperature of a catalytic converter situated in the exhaust pipe, and further comprises means for the evaluation of these signals as well as for the interruption of the fuel supply to the internal combustion engine and the introduction of supplementary air during overrunning at catalytic converter temperatures above the proper operating temperature for that device.

8 Claims, 1 Drawing Figure

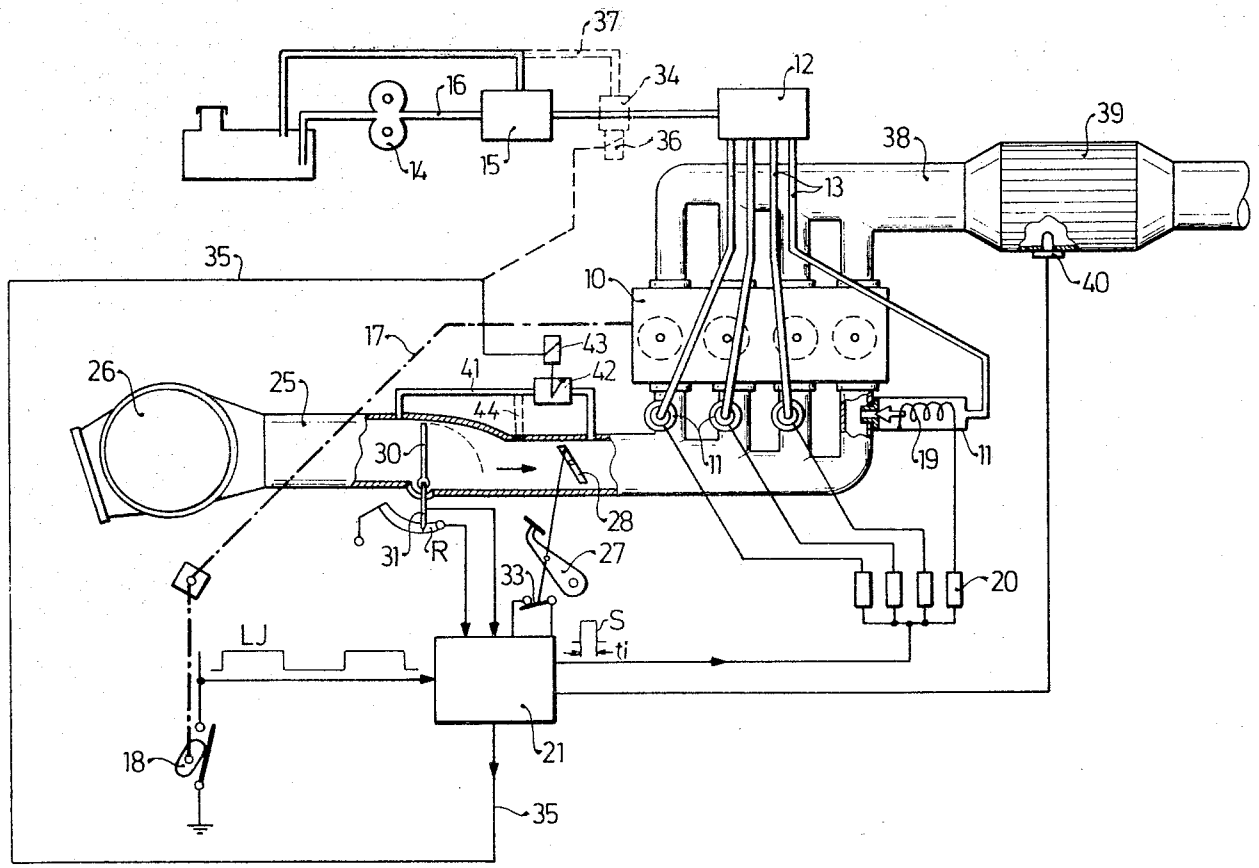
39
40
38
12
13
11
19
20
34
36
37
10
43
42
28
27
S
21
35
15
16
14
41
44
33
R
31
30
17
25
LJ
18
26
35

CONTROL APPARATUS FOR A FUEL SUPPLY SYSTEM FOR MIXTURE-COMPRESSING, EXTERNALLY IGNITED INTERNAL COMBUSTION ENGINES

This is a continuation of application Ser. No. 916,416 filed June 16, 1978 now abandoned.

BACKGROUND OF THE INVENTION

The invention is developed from a control apparatus of a fuel supply system for mixture-compressing, externally ignited internal combustion engines provided with a throttle member in the induction line and at least one catalytic converter situated in an exhaust line, the temperature of said converter being transmissible by means of a temperature sensor.

A control apparatus for a fuel supply system for an internal combustion engine is already known, in which a catalytic converter with a temperature sensor which measures the operating temperature is situated in the exhaust pipe, which control apparatus interrupts at least partially the supply of fuel or of the fuel-air mixture during unduly high catalytic converter temperatures. This, however, has the disadvantage that fuel is needlessly consumed before the fuel supply is interrupted and that exhaust gases are produced with a high proportion of toxic ingredients. In addition, with this known method the often desirable braking action of the motor during overrunning is impaired. Further, a control apparatus for a fuel supply system for an internal combustion engine is known, which furnishes such a large amount of air during overrunning of the engine that the supply of the fuel-air mixture is at least partly eliminated, which however results in the disadvantage, when such a control apparatus is employed in an internal combustion engine with a catalytic converter in the exhaust pipe, that the catalytic converter cools off during overrunning to below its lowest suitable operating temperature, and when normal fuel supply is reinstated after the overrunning is ended, the catalytic converter is at first too cold to reduce the noxious ingredients in the exhaust gas.

OBJECT AND SUMMARY OF THE INVENTION

The control apparatus according to the invention has the advantage of saving fuel and reducing noxious ingredients in the exhaust gas during overrunning of an internal combustion engine, whereby the lowering of the catalytic converter below its proper operating temperature is prevented.

By the means described in the specification and later set forth in the claims, advantageous developments and refinements of the control apparatus mentioned hereinbefore are made possible.

Of particular advantage as revealed in this application is the provision of a supplementary supply of air to the internal combustion engine during overrunning at catalytic converter temperatures above the operating temperature of that device, in order to increase the braking action of the engine.

The invention will be better understood as well as further objects and advantages thereof become more apparent from the ensuing detailed description of a preferred embodiment taken in conjunction with the drawing.

BRIEF DESCRIPTION OF THE DRAWING

The drawing shows an exemplary embodiment of the invention in simplified schematic form, which is described in detail in the following specification.

DESCRIPTION OF THE PREFERRED EMBODIMENT

The control apparatus for a fuel supply system for a mixture-compressing, externally ignited four-cylinder four-cycle internal combustion engine 10 comprises, as its most essential components, four electromagnetically operable fuel injection valves 11 to which the fuel to be injected is supplied from a distributor 12 via individual fuel lines 13, an electrically driven fuel supply pump 14, a pressure regulator 15 which keeps the fuel pressure in the fuel supply line 16 leading to the injection valves 11 at a predetermined constant value, and an electronic regulator unit 21 which will be described in more detail hereinafter. The electronic regulator unit is triggered twice during each rotation of the engine cam shaft 17 by means of a signal generator 18 operatively coupled to the cam shaft and thus delivers a rectangular electrical opening pulse S for each of the injection valves 11. The pulse width $t_i$ of the opening pulse shown in the drawing determines the opening time of the injection valves 11 and, accordingly, the quantity of fuel which leaves the inner chamber of the injection valves 11 during its respective opening period, the injection valves 11 being under a virtually constant fuel pressure of 2 bars. Each of the injection valves 11 has a magnetic winding 19, and each magnetic winding 19 is connected in series with a decoupling resistor 20 to a common amplifying and power stage of an electronic regulator unit 21. The electronic regulator unit 21 contains at least one power transistor, the emitter-collector path of which is connected in series with the decoupling resistors 20, and hence with the magnetic windings 19, whose other end is grounded.

In the operation of mixture-compressing and externally ignited internal combustion engines of this type, the fuel quantity provided to a particular cylinder during each piston suction stroke in accordance with the quantity of air drawn in is such that it can be completely combusted during the subsequent power stroke. To ensure that the internal combustion engine is used efficiently, it is extremely important that no substantial quantity of air remain in the cylinder after the power stroke. To provide the desired stoichiometric ratio of aspirated air and fuel, an air metering device is provided in the suction tube 25 of the internal combustion engine. The air metering device is located downstream of an air filter 26 but upstream of a throttle butterfly valve 28 of the engine. The butterfly valve 28 is adjustable by means of the gas pedal 27. The air flow rate meter consists essentially of a baffle plate 30 and a variable potentiometer R, the adjustable tap 31 of which is coupled to the baffle plate 30. The electrical output of the air metering device is fed to the electronic regulator unit 21 whose own output supplies the injection pulses of width $t_i$.

The electronic regulator unit 21 is known, for example, from U.S. Pat. No. 3,750,631, and includes two transistors in push-pull operation and connected in mutual feedback configuration and it also includes an energy storage device which may be a capacitor or an inductor. The duration of the discharging process of the energy storage device determines the opening duration $t_i$ for the injection valves. For this purpose, the energy storage device must be charged in an appropriate manner prior to each discharging process operation.

The charging process of the energy storage device is accomplished by a switch, embodied in this example by a signal generator 18 which is actuated in synchronism with the crankshaft rotation, which provides that the energy storage device is connected to a source of electric charge during a predetermined, constant angular motion of the crankshaft. The generator 18 thus provides a charging pulse LJ which makes available a charging current during this time. At the same time, the regulator unit 21 receives information regarding the air quantity admitted through the suction tube of the engine during this interval. In the present case, let it be assumed that the signal generator 18, which may also be embodied in a practical situation by a bi-stable multivibrator clocked by ignition pulses, is closed over a crankshaft angle of 180° and is then opened over the remaining angle of 180°.

The period of overrunning of the internal combustion engine can be characterized by the signals for rpm of the engine divided by idling rpm and by attitude of the throttle valve in idling position. A throttle valve switch 33 serves to transmit the idling position of the throttle valve 28 by means of the gas pedal 27. Thus, the switch 33 closes the throttle valve, thereby transmitting the appropriate signal to the electronic regulator unit 21. The rpm of the internal combustion engine are fed to the electronic regulator unit 21 by the signal generator 18. If the signals which characterize overrunning of the internal combustion engine are provided to the electronic regulator unit 21, then on the one hand the injection signal $t_i$ can be interrupted at the outlet side of the electronic regulator unit, so that the injection valves 11 receive no further signals to open up. However, on the other hand, as is shown with broken lines in the drawing, a shutoff valve 34 can be arranged in the fuel supply line 16 and controlled by the outlet signal of the electronic regulator unit 21 over a line 35 and an electric servomotor 36 during overrunning in such a way that it closes off the fuel supply line 16 to the distributor 12 and opens a bypass 37, which leads on the induction side back to the fuel delivery pump 14.

In order to reduce noxious ingredients in the exhaust, a catalytic converter 39 is arranged in the exhaust pipe 38 and arranged to have its temperature measured by a temperature sensor 40 and then transmitted back to the electronic regulating unit 21.

According to the invention, the interruption of the fuel supply during overrunning is controlled in such a way that an interruption of the fuel supply is only effected when the catalytic converter temperature is higher than its proper operating temperature, while contrarily the interruption of the fuel supply is ended as soon as the catalytic converter temperature falls below its proper operating temperature. In this way the condition no longer arises where the catalytic converter 39, when normal running of the engine begins after a period of overrunning, cannot reduce noxious exhaust ingredients because it is below its proper operating temperature. In order to prevent stalling when the engine is disengaged from the motor vehicle during overrunning, there is an rpm switch in the electronic regulator unit 21 which ends the interruption of the fuel supply in a temperature-dependent manner between 1,000 and 1,500 rpm, so that the engine can continue to idle.

If the fuel supply to the engine during overrunning is completely turned off, the engine will be entirely pulled, that is, it will operate as a compressor. In this way the braking action of the motor is greater than in normal engine operation with combustion during overrunning. The braking action may be further increased if provision is made for supplying the engine during overrunning with air alone, at the greatest possible degree of admission (corresponding to full-load operation), so that the compression capacity of the engine, which is equivalent to braking capacity, is as great as possible. To this end, it is efficient to introduce supplementary air into the induction line downstream of the throttle valve during overrunning. As is shown in the drawing, this can be accomplished by means of an air bypass 41, containing a shutoff device 42, which connects the induction line section upstream of the air metering device 30 with that downstream of the throttle valve 28. The shutoff device 42 is opened only during overrunning, by means of a setting device 43 controlled by a signal characterizing the overrunning stage, the signal being transmitted by the electronic regulator unit 21 over the line 35. The air bypass 41 can also be embodied as shown in the drawing with broken lines at 44, which connect the induction line section between the air metering device 30 and the throttle valve 28 with the induction line section downstream of the throttle valve 28. The characteristics according to the invention can also be applied without limitation to a control apparatus for a fuel supply system embodied as a mechanical fuel injection system or as a carburetor for internal combustion engines. Thus, the control apparatus according to the invention enables a fuel saving and a reduction of noxious ingredients in the exhaust, while the catalytic converter is at a temperature above its operating temperature, and at the same time enables good braking action while the internal combustion engine is overrunning.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A control apparatus of a fuel supply system for mixture-compressing, externally ignited internal combustion engines having a means supplying only fuel of a fuel/air mixture, an induction line and an exhaust line, a throttle member in said induction line, at least one catalytic converter situated in said exhaust line, a temperature sensor for sensing the temperature of said catalytic converter and control means responsive to the temperature of said temperature sensor, further wherein the control means is connected to the means for supplying only fuel, such that the control means interrupts the supply of fuel during overrunning of the internal combustion engine only when the minimum operational temperature of said catalytic converter is exceeded.

2. A control apparatus according to claim 1 including an air bypass means disposed in the induction line, said air bypass means being arranged to be opened during overrunning of the internal combustion engine for the duration of the interruption of said fuel supply by said interrupting means.

3. A control apparatus according to claim 2, wherein said induction line includes sections upstream and downstream of said throttle member, wherein said air bypass means in said induction line straddles said throttle member and provides communication between upstream and downstream sections of said induction line.

4. A control apparatus according to claim 2 including an air metering device disposed in the induction line upstream of said throttle member.

5. A control apparatus according to claim 1, wherein said fuel supply includes a delivery pump, a pressure regulator, a distributor and a line extending from said delivery pump through said pressure regulator to said distributor that transports fuel to fuel injection valves, a shutoff valve means disposed in said line between said pressure regulator and said distributor, said shutoff valve means being arranged to feed fuel back to said delivery pump.

6. A control apparatus according to claim 5, wherein said shutoff valve means only transports fuel back to the delivery pump during overrunning of said engine.

7. A control apparatus according to claim 2, wherein said fuel supply includes a fuel supply point and wherein said air bypass means in said induction line is connected between a location upstream of said fuel supply point and a location downstream of said throttle member.

8. A control apparatus according to claim 4, wherein said air bypass means in said induction line is connected between a location upstream of said air metering device and a location downstream of said throttle member.

* * * * *